US006591747B2

(12) United States Patent
Buch et al.

(10) Patent No.: US 6,591,747 B2
(45) Date of Patent: Jul. 15, 2003

(54) METHOD AND APPARATUS FOR CORRECTING REGISTER FAULTS IN A PRINTING MACHINE

(75) Inventors: Donald Buch, Penfield, NY (US); Heiko Hunold, Wattenbek (DE); Michael Kowalczyk, Rochester, NY (US); Christopher Liston, Rochester, NY (US); Patrick Metzler, Gettorf (DE); Robert Peffer, Penfield, NY (US); Karlheinz Walter Peter, Kiel (DE); John Robert Thompson, Webster, NY (US)

(73) Assignee: Nexpress Solutions LLC, Rochester, NY (US)

( * ) Notice: Subject to any disclaimer, the term of this patent is extended or adjusted under 35 U.S.C. 154(b) by 2 days.

(21) Appl. No.: 09/859,845

(22) Filed: May 17, 2001

(65) Prior Publication Data

US 2001/0050010 A1 Dec. 13, 2001

Related U.S. Application Data

(60) Provisional application No. 60/204,680, filed on May 17, 2000.

(51) Int. Cl.[7] ..... B41M 1/14; G03G 15/01

(52) U.S. Cl. ..... 101/211; 347/116

(58) Field of Search ..... 101/211, 93, 93.01, 101/182; 347/116, 115; 358/1.1, 1.18; 399/299, 301, 394

(56) References Cited

U.S. PATENT DOCUMENTS 5,806,430 A * 9/1998 Rodi ..... 101/211
6,278,857 B1 * 8/2001 Monji et al. ..... 347/116

* cited by examiner

*Primary Examiner*—John Barlow
*Assistant Examiner*—An H. Do
(74) *Attorney, Agent, or Firm*—Lawrence P. Kessler

(57) ABSTRACT

Correcting register faults in a multicolor printing machine having a number of items of equipment for the digital production of color separations, wherein correction values are determined and assigned to angular positions of at least one image cylinder and, as a result, taken into account for the control of the production of the color separations on the image cylinder. Correction values are to be made available for the correction of register faults, which, with a fine graduation, make it possible to assign them to angular positions of machine elements in a repeatable way. This is achieved by determining circularity errors of machine elements which have an influence on the register, assigned to their angular positions and, from these, the correction values for the control of the production of the color separations on the at least one image cylinder being determined.

24 Claims, 1 Drawing Sheet

METHOD AND APPARATUS FOR CORRECTING REGISTER FAULTS IN A PRINTING MACHINE

The application claims the benefit of Provisional Appl. 60/204,680 filed May 17, 2000.

FIELD OF THE INVENTION

The invention relates to correcting register faults in a multicolor printing machine having a number of items of equipment for the digital production of color separations, correction values being determined and assigned to the angular positions of at least one image cylinder and, as a result, being taken into account for controlling the production of color separations on such image cylinder.

BACKGROUND OF THE INVENTION

Printing colored illustrations, in particular colored images, may be carried out by a number of color separations being printed over one another. These are generally the colors yellow, magenta and cyan as well as black. If required, special colors are added. By overprinting these colors, all color compositions can be achieved, the quality of the prints depending significantly on the in-register overprinting of the color separations. In the case of digital printing processes, for example electrostatic printing processes, the maintenance of the register of the overprint is achieved by the image production devices being controlled in such a way that the color separations meet one another in-register when the are transferred to a printing substrate.

U.S. Pat. No. 5,287,162 discloses a method and apparatus in which calibration tables are drawn up which contain correction values for setting images on the image cylinders. In order to draw up these calibration tables, register marks are printed by the various inking units and the times are registered which the register marks need from their production until their registration. Times of this sort are then used to determine correction values, which are assigned in the form of calibration tables to the angular positions of the image cylinders.

However, registering faults in this way by register marks has the disadvantage that the sum of all the faults is registered and, as a result, the individual fault sources can no longer be assigned to their periodic repetitions. Register faults are predominantly caused by non-roundness of machine elements that carry images or substrates. If non-roundnesses of other machine element, such as those of image transfer cylinders or of the drive roller of the carrier of printing substrates, are added to the non-roundnesses of the image cylinders, these can no longer be assigned directly to the angular positions of image cylinders by the aforementioned prior art, since these machine elements do not rotate absolutely simultaneously with the image cylinders. Such a simultaneous rotation is lacking even if the diameters are coordinated with one another, since phenomena such as slippage and overdrive occur. Overdrive is the name give to the more rapid rotation of cylinders—in which one cylinder drives the other—as related to rigid cylinders rolling on one another. This is caused by the compression of an elastic cover in the area of contact between the cylinders. Slippage can primarily occur when one machine element is driven by another, for example an image transfer cylinder by the carrier for printing substrates and such carrier in turn by the drive roller. The image cylinder can also be driven by the carrier or by the image transfer cylinder. In relation to the faults which repeat periodically with the rotation of a machine element, the registration of register marks also registers non-periodic changes, such as drifting, for example, as a result of temperature changes, although their assignment to periodic angular positions is not given. This in turn makes the analysis of the faults registered in total more difficult.

In addition, the printing of register marks is complicated, particularly since, for the assignment to angular positions, the continuous printing of register marks is necessary, comprising all the angular positions and angular position combinations of all the machine elements that influence the register. In addition, the accuracy of the calibration tables assigned to the angular positions is limited by the resolution accuracy of the printed register marks, and therefore precise correction for finely subdivided areas of the color separations is not possible.

SUMMARY OF THE INVENTION

The invention is therefore based on the object of making available correction values for correcting register faults which, with a fine graduation, can be assigned to angular positions of machine elements in a repeatable way.

With respect to the method, the object is achieved according to the invention by circularity errors of machine elements which have an influence on the register, being determined and assigned to their angular positions and, from them, the correction values for the control of the production of the color separations on the at least one image cylinder being determined.

With respect to the apparatus, the object is achieved according to the invention by the correction values being determined on the basis of circularity errors of machine elements which have an influence on the register, by the at least one controller being such that, by assigning the circularity errors to the angular positions of the machine elements, it determines the correction values referred to the angular positions of the at least one image cylinder for the control of the production of the color separations on the at least one image cylinder.

The advantage of the invention resides in the fact that the primary fault sources, which are based on non-roundnesses, can be assigned exactly to the machine elements, which have these non-roundnesses. In this way, the faults, with their periodic repetition with the angular positions of the relevant element, can be registered, and it is possible to control the setting of images on the image cylinders in such a way that these faults are compensated for. If, therefore, image starts or areas of a color separation are produced on the image cylinder, then the controller of the image production "knows" the faults together with their periodicities bound to the relevant machine elements, and can control the image production in such a way that the faults are already counteracted at the primary stage of image production by compensation, for example by stretching or compressing image components. During the production of an image, so to speak "faults" are incorporated which cancel out the transfer faults in such a way that a color separation which is in-register in all the sub-areas of the image is printed, and the various color separations arrive on the printing substrate in-register and correctly. The invention permits the pre-calculation of the faults, the fault sources with different periodicities being registered separately and therefore the calculation of the aforementioned image-setting with fault compensation being possible.

At the same time, the invention does not require the printing of register marks, since the non-roundnesses can be registered in another way, specifically in such a way that no confusion with faults with different periodicities or with faults with no periodicity occurs. Of course, the printing of register marks, the registration of image starts or image components can be carried out as well in order to make further corrections. At the same time, the advantage of the classified registration of faults with different periodicities is nevertheless maintained, since these faults can be compensated for before printed register marks are registered.

The transmission paths, which are provided for the color separations, are of no consequence for the invention. The equipment for producing the color separations can produce the latter on a single image cylinder or on an image cylinder in each case. The transfer of the color separations can then be carried out from the one image cylinder or the plurality of image cylinders directly onto the substrate, or further transfer elements can be provided, which transfer the already superimposed or the individual color separations separately. It is also possible for the color separations already to be superimposed on an image cylinder or to be superimposed only as they are transferred to the printing substrate or on the way to the latter on a transfer element.

The configuration of the invention with respect to the circularity errors to be taken into account depends on these transmission paths and transmission elements.

Provision can therefore be made, in order to determine the correction values, for the circularity errors of the image cylinders to be determined. For multicolor printing machines with image transfer cylinders, provision can be made, in order to determine the correction values, for their circularity errors to be determined as well and therefore taken into account for the control of the production of the color separations on the image cylinders. Furthermore, the circularity errors of the drive roller of a carrier for printing substrates can also be registered and taken into account when determining the correction values for the control of the production of the color separations on the image cylinders. With respect to the apparatus for implementing these method steps, sensors for registering these circularity errors and at least one controller, which calculates the correction values, are then provided. Specific configurations will be discussed further.

There are various possibilities for determining the circularity errors. Provision can be made for the circularity errors to be determined by direct measurement on the relevant machine element. However, it is also possible for the angular positions of the machine elements which have an influence on the register to be registered, and the circularity errors to be determined from the mutual assignment of the angular positions. With respect to the apparatus, provision is then made for devices tc determine the circularity errors and assign them to the angular positions. These may be sensors for registering circularity errors, or it is possible for the devices to be rotary encoders which are connected to a computer, which determines the circularity errors and therefore the correction values from the mutual assignment of the angular positions of the machine elements. Since the circularity errors are registered with the associated angular positions, these are the effective circularity errors with the incorporation of slippage, overdrive or similar phenomena.

The correction values can be provided merely for the image starts; in order to achieve a high precision in the prints, however, it is proposed that the correction values be assigned to defined areas of the color separations and taken into account for their production. The color separations may be individual image lines or groups of image lines. Provision is preferably made for the defined areas of the color separations to be determined by assigning image areas to defined angular sequences of the image cylinders. With respect to the apparatus, provision is made for the at least one controller to be designed in such a way that it takes into account the correction values for defined areas of the color separations during their production.

With respect to the correction values, provision may be made for them to be registered once and taken into account as machine-specific parameters. For this purpose, with respect to the apparatus, provision is made for the at least one memory to contain the circularity errors with their assignment to the angular positions as machine-specific nominal values.

The correction values can also be registered before a print is made and taken into account for this print. In this case, this may be a re-determination of the correction values or it is possible to make corrections of the machine-specific parameters. Of course, the correction values can also be registered and taken into account continuously. By continuous re-determination of correction values, it is in particular also possible to take into account drifting of the values, which can occur for example as a result of changes of temperature and stresses in the machine, by the correction values being updated continuously.

In order also to be able to make corrections over the image width, provision can be made for a number of correction values to be registered over the area of the image width and taken into account. However, it is also possible for a number of correction values to be registered over the area of the image width, and for an average correction value to be determined from these and taken into account. With respect to the apparatus, an appropriate arrangement of sensors and an appropriate design of at least one controller is needed for this purpose.

The above-mentioned registration of the data and determination of correction values for the control already leads to a good result and to a high maintenance of register without being checked by the printing of register marks or similar control fields. This is therefore particularly advantageous since register corrections of this type can be carried out very quickly. Of course, the invention does not exclude the correction values being checked by printing and registering color separations and, if necessary, corrected. Here, these color separations may be test prints of image starts or test prints of further defined areas of color separations. Of course, register marks can also be printed as test prints of color separations and evaluated appropriately. With respect to the apparatus, provision is then made for at least one sensor to register test prints, and an evaluation device which evaluates test prints, for example register marks, in order to check and correct the correction values.

The invention, and its objects and advantages, will become more apparent in the detailed description of the preferred embodiment presented below.

Of course, appropriate configurations of the apparatus can be assigned to the above-mentioned features described in terms of the method, and vice versa.

BRIEF DESCRIPTION OF THE DRAWING

In the following text, the invention will be explained using an exemplary embodiment illustrated in the figure.

DETAILED DESCRIPTION OF THE INVENTION

Figure 1:
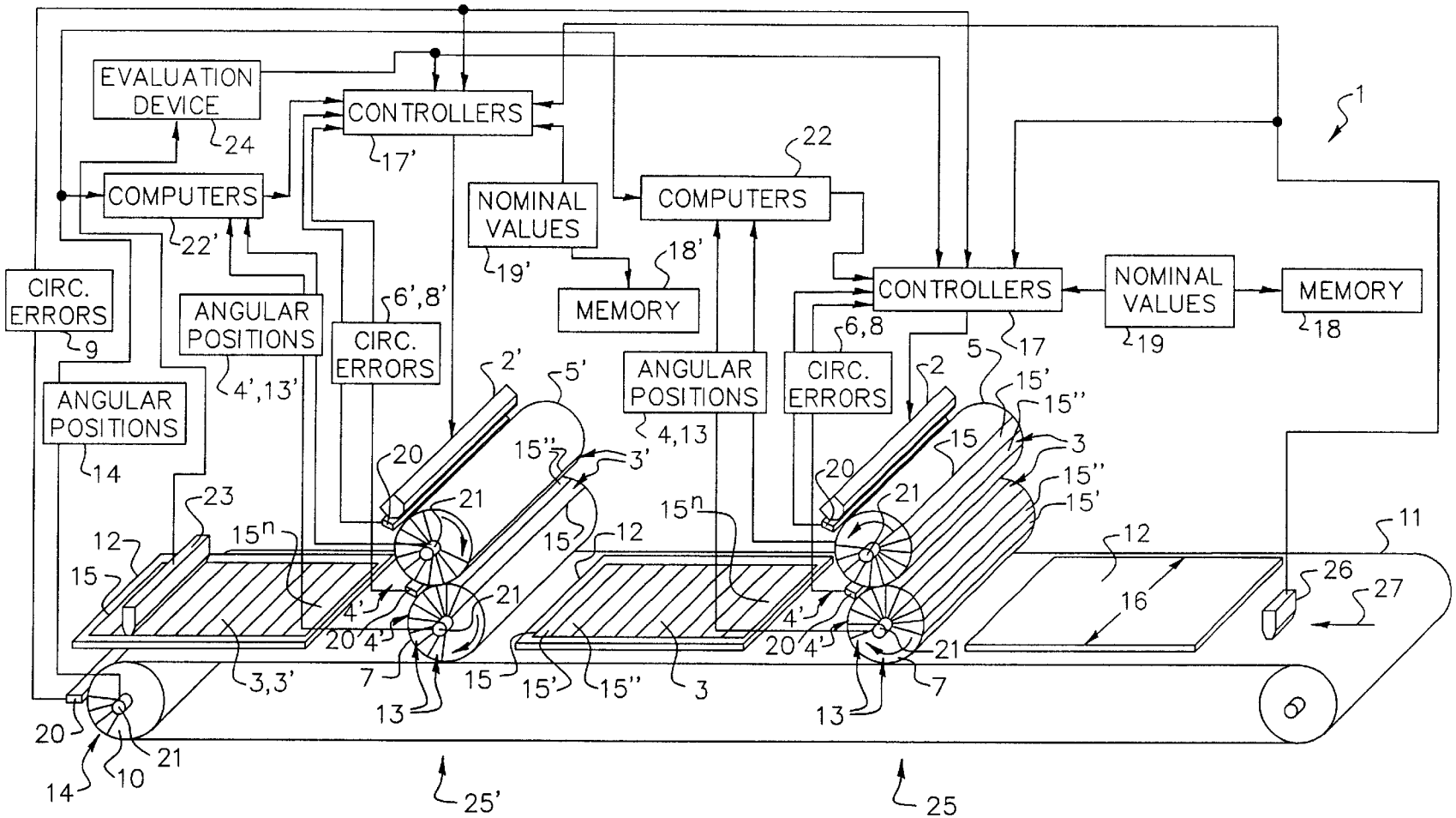

The figure shows a multicolor printing machine, only two printing units 25,25' having been illustrated out of the usual four or more printing units. This is used for simplification, further printing units of substantially identical construction have to be imagined as being added. Each printing unit 25,25' has equipment 2,2' for the digital production of color separations 3,3'. This equipment 2,2' is arranged on image cylinders 5,5'. The color separations 3,3' are firstly transferred from the image cylinders 5,5' to image transfer cylinders 7,7' in order then to be transferred from the latter to printing substrates 12. The printing substrates 12 are located on a carrier 11, which is driven by a drive roller 10 and moves the printing substrates 12 in the transport direction 27. At the same time, the image transfer cylinders 7,7' are driven via the drive to the drive roller 10 and the carrier 11, and the image cylinders 5,5' are in turn driven by the image transfer cylinders 7,7'. On the side of the carrier 11 opposite the image transfer cylinders 7,7' there are further impression rollers, which have been left out for the purpose of simplification. If a printing substrate 10 is registered by a sensor 26 for registering printing substrates 12, then signals are provided to controllers 17,17' in order to control the setting of an image on the image cylinders 5,5' by the equipment 2,2' in such a way that the color separations 3,3' are transferred in-register to the printing substrates 12.

For this in-register transfer of the color separations 3,3' to the printing substrates 12, the controllers 17,17' have to be supplied with data which contains the assignment of the printing units 25,25' to one another, as well as the transfer paths of the color separations 3,3'. In order to achieve clean prints, it is necessary that, in addition to this data, correction data are also available which take into account non-roundnesses of machine elements, such as those of image cylinders 5,5', of image transfer cylinders 7,7', or of the drive roller 10. Further data can contain other fault sources, which have an influence on the maintenance of register. The aforementioned data and the correction data can be deposited in memories 18,18' as machine-specific nominal values 19,19'. This storage of machine-specific nominal vales 19,19' can be carried out by the machine manufacturer, or it is possible to update these machine-specific nominal values 19,19' from time to time or continuously.

One example of updating or obtaining in this way the data which the controllers 17,17' need in order to control the equipment 2,2' provides for arranging sensors 20 to measure circularity errors. Sensors 20 of this type can be arranged on the image cylinders 5,5', on the image transfer cylinders 7,7', on the drive roller 10 or on further machine elements which have an influence on the maintenance of register in the prints. These sensors 20 for measuring circularity errors determine the circularity errors 6,6' of the image cylinders 5,5', the circularity errors 8,8' of the image transfer cylinders 7,7', and the circularity errors 9 of the drive roller 10. This data is fed to the controllers 17,17', which assign these circularity errors 6,6'; 8,8'; and 9 to the angular positions 4,4'; 13,13'; and 14 of the machine elements 5,5'; 7,7'; and 10, and from these, calculate the correction values referred to the angular positions 4,4' of the image cylinders 5,5' for the control of the production of the color separations 3,3' on the image cylinders 5,5' and incorporate the corrections into the control of the production of the images.

In addition to a correction by stored machine-specific nominal values 19,19' and a correction based on the measurement of circularity errors, there is a further possibility for correcting register faults. Provision can be made for rotary encoders 21 to measure the angular positions 4,4'; 13,13'; and 14 of all the machine elements 5,5'; 7,7'; and 10 that have an influence on the register, and for computers 22,22' to calculate the circularity errors 6,6'; 8,8'; and 9 and therefore the correction values from the mutual assignment of the angular positions 4,4'; 13,13'; and 14. For this purpose, rotary encoders 21 are assigned to the image cylinders 5,5', the image transfer cylinders 7,7' and the drive roller 10. Each printing unit 25,25' is equipped with a computer 22,22', which in each case is connected to the controllers 17,17' of the printing units 25,25'. These data can also be used by the controllers 17,17' to control the setting of images on the image cylinders 5,5' and possibly to update the machine-specific nominal values 19,19' for the next print.

In the exemplary embodiment, various correction possibilities were included, namely the memories 18,18' with the machine-specific nominal values 19,19', the sensors 20 for measuring circularity errors, and the rotary encoders 21 with computers 22,22'. Of course, it is sufficient to provide one of these three possibilities or to combine the memories 18,18' with the registration of circularity errors by sensors 20 or with the registration of circularity errors by rotary encoders 21 and computers 22,22'.

In addition, the illustration shows how the printing substrate 12 upstream of the printing unit 25 still contains no color separation, and the color separations 3,3' are applied to the printing substrates 12 by the printing units 25,25'. The central printing substrate 12 therefore contains one color separation 3, and the left-hand printing substrate 12 therefore contains two color separations 3 and 3'. In this way, as a rule four color separations are applied to the printing substrates 12 by four printing units, only two units 25,25' being shown in the figure.

On the right-hand printing substrate 12, the image width 16 is drawn in order to illustrate that it is possible to register the above-mentioned data over the entire image width 16, for example in order to calculate an average value, on which the control of the production of color separations 3,3' is then based. The connections between the individual elements are illustrated by links and arrows for the data flow.

In addition to the correction according to the invention of register faults, it is of course also further possible to provide a sensor 23 to register test prints, for example register marks, which is connected to an evaluation device 24, which calculates corrections and makes these available to the controllers 17,17' to update the correction values.

Of course, the exemplary embodiment illustrated is only exemplary; any desired machine configurations are conceivable, as was already mentioned at the beginning.

Parts List

2,2' Equipment for the digital production of color separations
3,3' Color separation
4,4' Angular positions of the image cylinders
5,5' Image cylinders
6,6' Circularity errors of the image cylinders
7,7' Image transfer cylinders
8,8' Circularity errors of the image transfer cylinders
13,13' Angular positions of the image transfer cylinders
17,17' Controllers
18,18' Memories
19,19' Machine-specific nominal values
22,22' Computers
25,25' Printing units

What is claimed is:

1. A method of correcting register faults in a multicolor printing machine having a number of items of equipment for the digital production of color separations comprising the steps of:

determining correction values assigned to the angular positions of at least one image cylinder and, as a result, being taken into account for the control of the production of the color separations on said image cylinder;

determining circularity errors of machine elements which have an influence on the register assigned to their angular positions; and from these circularity errors, determining the correction values for the control of the production of the color separations on the at least one image cylinder.

2. The method as claimed in claim 1, wherein in order to determine the correction values, determining circularity errors of the image cylinders.

3. The method as claimed in claim 2, wherein for multicolor printing machines with image transfer cylinders, in order to determine the correction values, determining circularity errors of such image transfer cylinders and taken into account for the control of the production of the color separations on the image cylinders.

4. The method as claimed in claim 3, further determining circularity errors of the drive roller of a carrier for the printing substrates and taken into account when determining the correction values for the control of the production of the color separations on the image cylinders.

5. The method as claimed in claim 4, wherein circularity errors are determined by direct measurement on the relevant machine element.

6. The method as claimed in claim 4, wherein angular positions of the machine elements which have an influence on the register are determined, and determining circularity errors from the mutual assignment of the angular positions.

7. The method as claimed in claim 6, wherein in determining correction values, correction values are assigned to defined areas of the color separations and taken into account for their production.

8. The method as claimed in claim 7, wherein defined areas of the color separations are determined by the assignment of image areas to defined angular sequences of the image cylinders.

9. The method as claimed in claim 8, wherein correction values are determined once and taken into account as machine-specific parameters.

10. The method as claimed in claim 9, wherein correction values are determined before a print is made and are taken into account for this print.

11. The method as claimed in claim 9, wherein correction values are determined and taken into account continuously.

12. The method as claimed in claim 11, wherein a number of correction values are determined over the area of the image width and are taken into account.

13. The method as claimed in claim 11, wherein a number of correction values are determined over the area of the image width, and an average correction value is taken into account.

14. The method as claimed in claim 13, wherein correction values are checked by printing and registering color separations and, if appropriate, are corrected.

15. The method as claimed in claim 14, wherein test prints of image starts are printed as color separations.

16. The method as claimed in claim 15, wherein test prints with further defined areas of the color separations are printed as color separations.

17. The method as claimed in claim 16, wherein register marks are printed as color separations.

18. Apparatus for correcting register faults in a multicolor printing machine having a number of items of equipment for the digital production of color separations, at least one controller for controlling the same and at least one memory, in which data for determining correction values, assigned to the angular positions of at least one image cylinder, for the production of the color separations are stored, comprising:

a device for determining correction values on the basis of circularity errors of machine elements which have an influence on register, wherein said at least one controller assigns circularity errors to the angular positions of machine elements, and determines the correction values referred to angular positions of the at least one image cylinder for the control of the production of the color separations on the at least one image cylinder.

19. The apparatus as claimed in claim 18, wherein said at least one memory contains circularity errors with their assignment to respective angular positions as machine-specific nominal values.

20. The apparatus as claimed in claim 19, further including devices to determine circularity errors and their assignment to angular positions.

21. The apparatus as claimed in claim 20, wherein said devices are sensors for determining circularity errors.

22. The apparatus as claimed in claim 20, wherein said devices are rotary encoders, which are connected to at least one computer, said at least one computer determining circularity errors and therefore the correction values from mutual assignment to angular positions of machine elements.

23. The apparatus as claimed in claim 22, wherein said at least one controller takes into account correction values for defined areas of the color separations as they are produced.

24. The apparatus as claimed in claim 23, further including at least one sensor for sensing test prints, and an evaluation device to evaluate such test prints to check and correct correction values.

* * * * *